United States Patent [19]

Badon

[11] 4,008,497

[45] Feb. 22, 1977

[54] SWIMMING POOL PLAY PEN

[76] Inventor: Kenneth E. Badon, 1318 Ryan St., Lake Charles, La. 70601

[22] Filed: Feb. 21, 1975

[21] Appl. No.: 551,590

Related U.S. Application Data

[62] Division of Ser. No. 387,969, Aug. 13, 1973, Pat. No. 3,874,005.

[52] U.S. Cl. ..... 4/171; 5/99 C; 9/400; 61/86

[51] Int. Cl.[2] ..... E04H 3/19; E04H 3/16; E02B 17/00

[58] Field of Search ... 5/93, 98 R, 99 R, 99 A–99 C, 5/11; 4/171; 9/400

[56] References Cited

UNITED STATES PATENTS

| | | | |
|---|---|---|---|
| 1,752,191 | 3/1930 | Moray | 4/171 |
| 2,641,772 | 6/1953 | Cook | 5/11 |
| 2,834,031 | 5/1958 | Johansen | 5/11 |
| 3,195,152 | 7/1965 | Gottlieb | 5/99 R |
| 3,571,819 | 3/1971 | Puncochar | 4/171 |
| 3,800,341 | 4/1974 | Daranzo | 5/99 R |
| 3,813,703 | 6/1974 | Beaudin, Jr. | 4/172 |
| 3,874,005 | 4/1975 | Baldon | 4/171 |

*Primary Examiner*—Casmir A. Nunberg
*Attorney, Agent, or Firm*—Pugh & Keaty

[57] ABSTRACT

The present invention pertains to a novel swimming pool playpen means comprising a foraminous enclosure adapted for suspension in a body of water such that its bottom portion can be operably positioned a pre-determined relatively shallow depth beneath the surface of the water. One preferred embodiment includes adjustable support means for resting the playpen upon the water bottom and another preferred embodiment is directed to flotation means operably connected to the playpen for suspending it within a body of water and whereby it can be conveniently relocated with very little effort. The enclosure portion of the present swimming pool playpen is preferably constructed of a rigid tubular frame over which a foraminous material is mounted.

4 Claims, 9 Drawing Figures

SWIMMING POOL PLAY PEN

CROSS-REFERENCE TO RELATED APPLICATION

The present application is a divisional application of the earlier filed co-pending patent application Ser. No. 387,969, entitled SWIMMING POOL PLAY PEN, filed Aug. 13, 1973 now U.S. Pat. No. 3,874,005 issued Apr. 1, 1975, entitled "Child's Safety Playpen For Use in Water."

BACKGROUND OF THE INVENTION

The present invention pertains to those arts concerned with an infant's playpen. More particularly, the present invention provides a unique playpen for use in water, both for the protection of young children as well as for their amusement.

In attending a small child or an infant in a swimming pool or the water, there is a constant threat of the child drowning for many different reasons. This problem magnifies itself when the attendant of the child is also engaged in swimming. Should the attendant stray into deeper water, the child may attempt to follow the attendant into the deeper water since such would be a natural act of a child. On such situations, it is convenient to be able to take the child into deeper waters whereby both the attendant and the child can simultaneously enjoy the water.

There are numerous non-sinkable or buoyant devices sold today for supporting children in the water whereby they need not be constantly held in an attendant's hands. Typical of such devices are those as disclosed in U.S. Pat. Nos. 1,764,852; 2,562,080; 2,946,068; 3,074,084; and 3,161,897. A common problem of such devices is that children quite often are able to move about too freely whereby they either crawl or fall out of the devices. In any event, since the child is not restrained therein and if the child separates himself in some manner or means, he will be exposed to drowning.

The present invention overcomes these and other related prior art problems by providing a playpen adaptable for use in a swimming pool or water whereby the depth of water within the playpen can be easily regulated without very much effort. As is well known, playpen structures similar in structure to those used in the present invention are relatively light weight and portable, and can be manually moved about.

Among the advantages and features of the present invention is the fact that it is virtually impossible for a child to become separated from the present playpen and be placed in the jeopardy of drowning. These and other unique advantages and features of the present invention will become evident in light of the following detailed description of the preferred embodiments of the present invention.

DESCRIPTION OF THE PREFERRED EMBODIMENT

Figure 1:
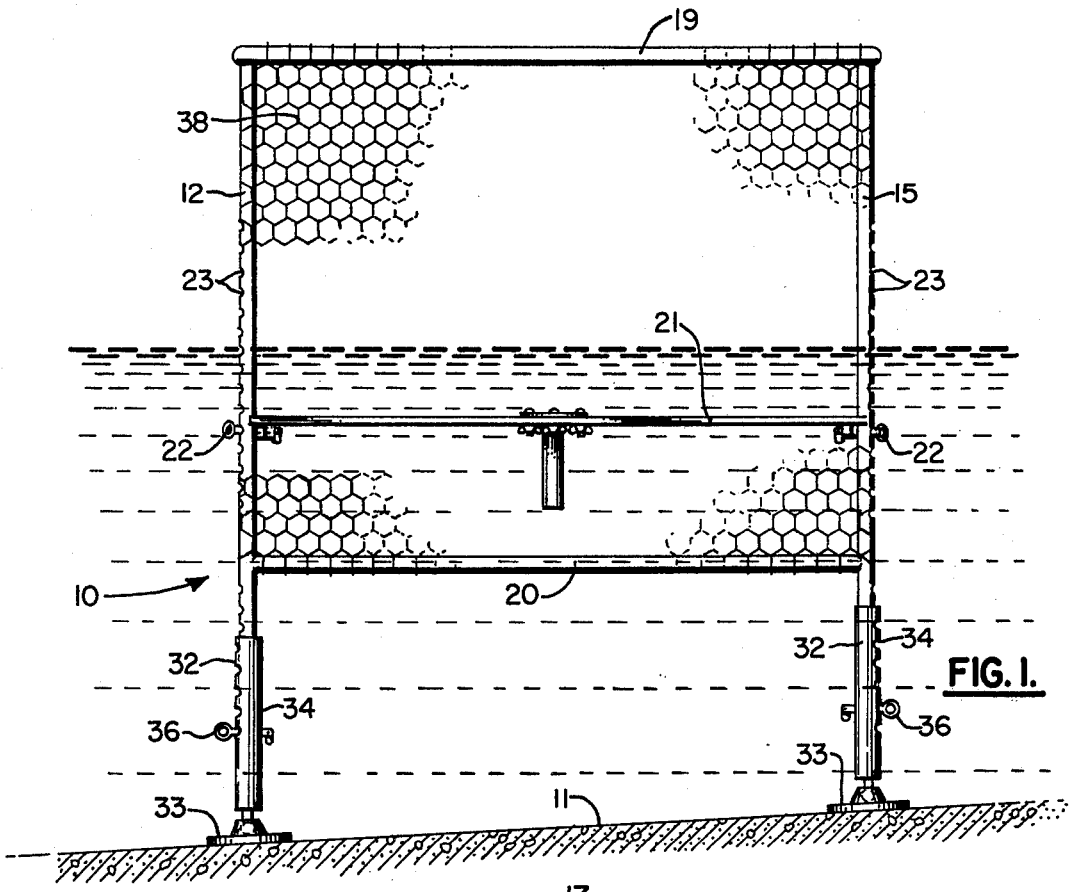
FIG. 1 in the drawings is a side elevational view of one preferred embodiment of the present invention.
Figure 2:
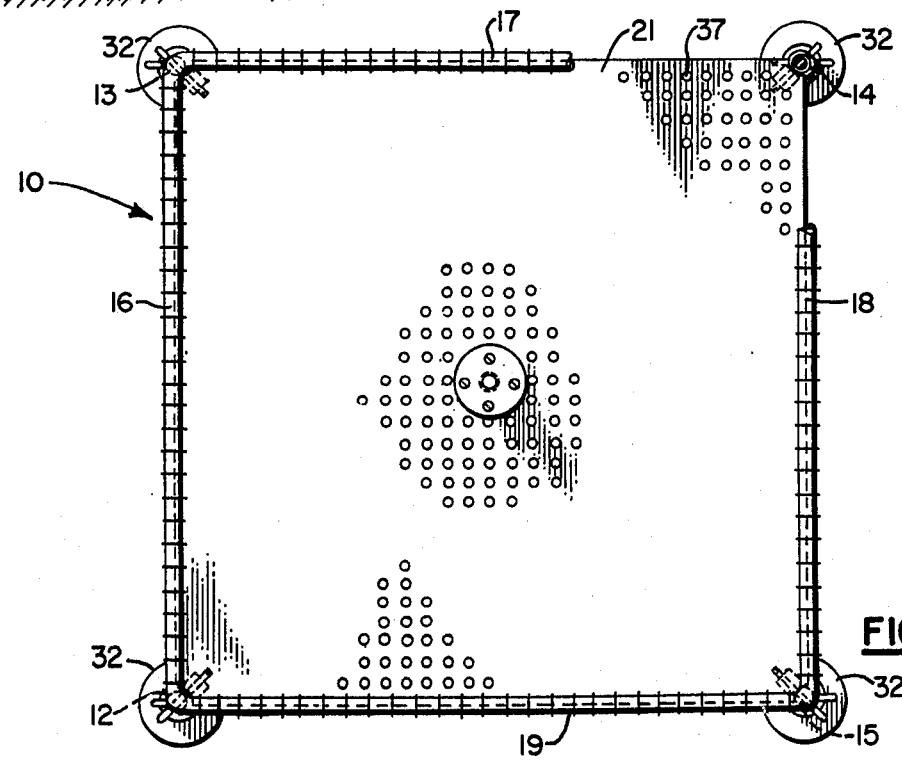
FIG. 2 in the drawings depicts a plan view of the embodiment of FIG. 1 with a partial cutaway portion showing certain details of the bottom support of the present playpen.

Referring to FIGS. 1 and 2 in the drawings, the preferred embodiment of the present playpen 10 illustrated therein is shown as being adapted for resting upon the bottom 11 of swimming pool. For simplicity of design as well as ease of manufacture and maintenance, the structural support members which together form the basic structural skeleton or support frame of the present device are preferably tubular members constructed of a rust resistant material, such as aluminum, chromium plated steel or galvanized steel so as to be water compatible. The vertically oriented members 12, 13, 14 and 15 are spaced apart in an operable relationship so as to preferably define a square floor plan. The top ends of these members in turn are connected together by the top cross members 16, 17, 18, and 19 which are preferably rigidly affixed to their respective vertical stanchions by suitable means, such as by welding or the like.

The stanchions 12, 13, 14, and 15 are also connected together along their bottom portion by the lower cross support members 20 as shown in FIG. 1 of the drawings. The drawings illustrate only a side elevation view of the lower cross support members 20 and hence, those members connecting the stanchions 12 and 13, 13 and 14, and 14 and 15 are not illustrated. The lower cross support members 20 are also suitably affixed to their respective stanchions, such as by welding.

The present playpen 10 is provided with the platform support member means 21 for supporting an infant within the enclosure defined by the stanchions 12, 13, 14, and 15 and the top cross support members 16, 17, 18, and 19 which form playpen wall enclosure means. The platform 21 is preferably a foraminous rigid member, being provided with the holes 37, capable of supporting an infant of average weight and age for which the present playpen would be designed as desired. As illustrated, particularly in FIG. 2, the holes 37 are located across the width and bredth of the playpen 21. Use of a foraminous platform also reduces the weight of that member which is especially designed when employing heavier materials of construction, such as galvanized steel.

Figure 5:
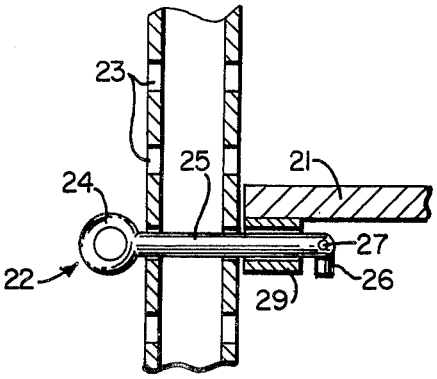
FIG. 5 is an isolated sectional view of the adjustable support means of FIG. 4 taken along the section line 5—5.

The platform 21 is constructed and arranged relative to its supporting superstructure whereby its elevation can be raised or lowered by variable support means. This is accomplished by provision of the adjustable toggle support pin means 22 which, as shown in FIG. 5 of the drawings, are operably designed to bayonnet within selected ones of the series of support holes 23 provided in each of the respective stanchions 12, 13, 14, and 15 as shown in detail in FIG. 5. As can be seen in the figures, the support holes 23 extend along a substantial length of the stanchions.

The toggle support pin 22 further comprises the eyelet portion 24 which is designed such that an operator can readily grab the pin for removal and insertion within the holes 23. The eyelet portion 24 is connected to the elongated shank portion 25 which is of a diameter such that it will fit snugly without interference within the holes 23. The toggle pin 22 is also provided with the toggle retainer member 26 which is pivotably connected to the shank portion 25 of the pin 22 by virtue of a connecting pin 27. The shank portion 25 is provided with a vertical slot traversing its end wherein the toggle retainer 26 is suspended by virtue of the pin 27.

Figure 4:
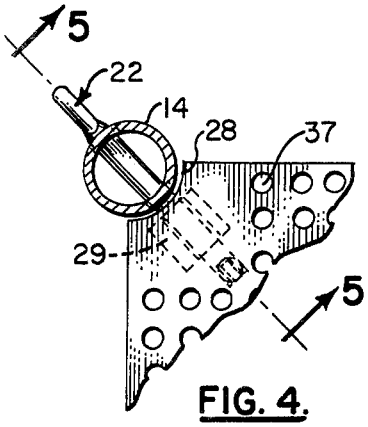
FIG. 4 of the drawings is an isolated plan view of adjustable means for varying the elevation of the playpen bottom.

The support platform 21 is preferably provided with the groove 28 in each of its corners adapted to mate with the outer peripheral surface of a respective support stantion as shown in FIG. 4 of the drawings illustrated with regard, for instance, to the stanchion 14. Each corner of the platform 21 is also preferably provided with the pin retaining collar 29 which is affixed to the bottom of the support 21 at each of its corners. The collars 29 are oriented as shown in FIG. 4 of the drawings such that the toggle support pin 22 can by bayonneted through a hole 23 provided in the stanchion 14 as well as through the collar 29 to thereby safely secure each corner of the platform 21 to its respective support stanchion. In such an operation, the pin 22 is first arranged whereby the toggle retainer 26 is positioned essentially parallel to that of the shank portion 25 which is accomplished by supporting the pin 22 such that the plane defined by its bottom portion 24 is essentially parallel to the ground. After insertion of the pin through the respective hole 23 and the collar 29, it is then twisted 90° whereby the toggle retainer member 26 pivots downward due to gravity and assumes a position essentially perpendicular to the longitudinal axis of the shank portion 25. This provides a means of safety for preventing the pin 22 from vibrating or being accidentally knocked out of the collar 29 which would allow the platform 21 to drop lower in the water endangering the life of the infant within the enclosure.

The superstructure defined by the stanchion 12, 13, 14 and 15, and the connecting cross members 16, 17, 18, 19 and 20 are covered with the foraminous material 38 which is preferrably rust resistant and thereby water compatible to thereby withstand the environment, and can be made of materials such as a nylon mesh, galvanized wiring, or the like. The material 38 is stretched over the vertical sides of the superstructure so as to define an enclosed column or walled enclosure wherein the elevation of the foraminous platform 21 can be regulated as desired. The holes 23 are positioned between the top cross supports 16, 17, 18, and 19 and the lower cross supports 20 over which the mesh 38 expands so that the child 31 is confined regardless of the elevation at which the platform 21 is set. The number of the holes 23 and the spacing of the cross support members can be varied a substantial amount as desired, primarily depending upon the depth of water in which the present playpen is to be utilized which would be generally within a water depth of 3 to 4 feet. In any event, taking into consideration these design parameters, the depth of the water level 30 to which the infant 31 is immersed can be easily controlled depending upon the capabilities of the infant to handle himself in water.

In the embodiment of FIGS. 1 and 2 of the drawings, the present playpen 10 is rigidly affixed to the support stand 32. The stand 32 further comprise a swivel-mounted foot member 33 which in turn is operably connected to the sleeve portion 34. The sleeve member 34 is of a diameter sufficient to receive the lower portion of the respective stanchion which accordingly telescopes therein. The lower portion of each of these stanchions 12, 13, 14 and 15 are also provided with a series of holes or apertures 35, as well as the sleeve portion 34 of stanchion 32, the holes in both of these members being spaced apart such that they are in alignment when the members are operably fitted together. The toggle support pins 36, similar to the toggle pins 22, are provided for attaching the stand 32 to a respective support stanchion. This is operably accomplished in a manner functionally equivalent to the manner by which the pins 22 support the platform 21 in operable position, with however, the pins 36 being of shorter length. By virtue of the fact that the foot members 33 are swivelmounted, the present playpen 10 can be readily mounted upon the inclined surface 11, the differences in elevations between the pair of stanchion 12 and 13, and 14 and 15 being taken into consideration by adjusting the depth of penetration of the bottom portion of the respective stanchion within the sleeve member 34 of a given stand 32, for example, as illustrated in the side elevational view of FIG. 1.

Figure 3:
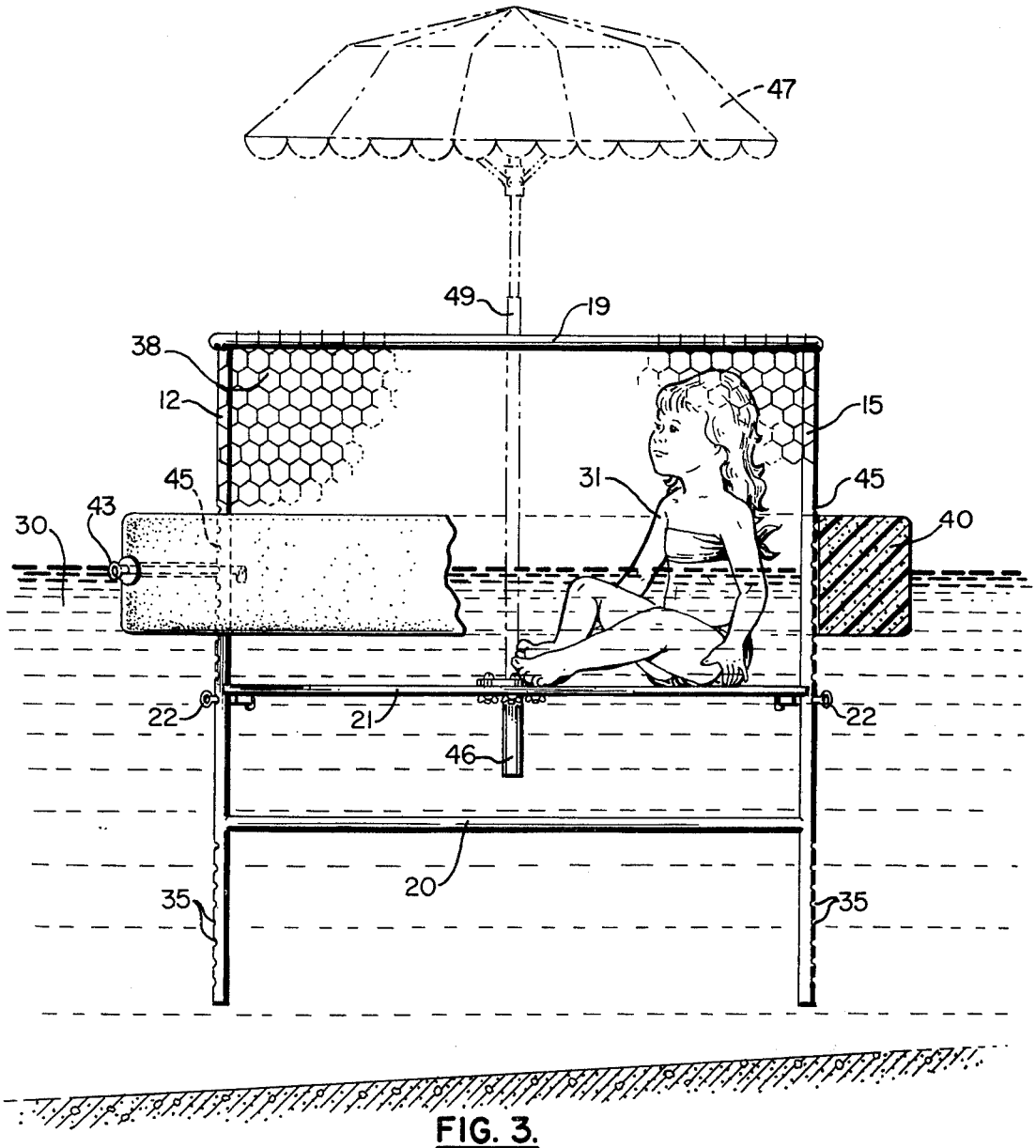
FIG. 3 in the drawings depicts another preferred embodiment of the present invention with a partial cutaway portion showing certain details of the flotation collar which supports the playpen in a body of water.
Figure 6:
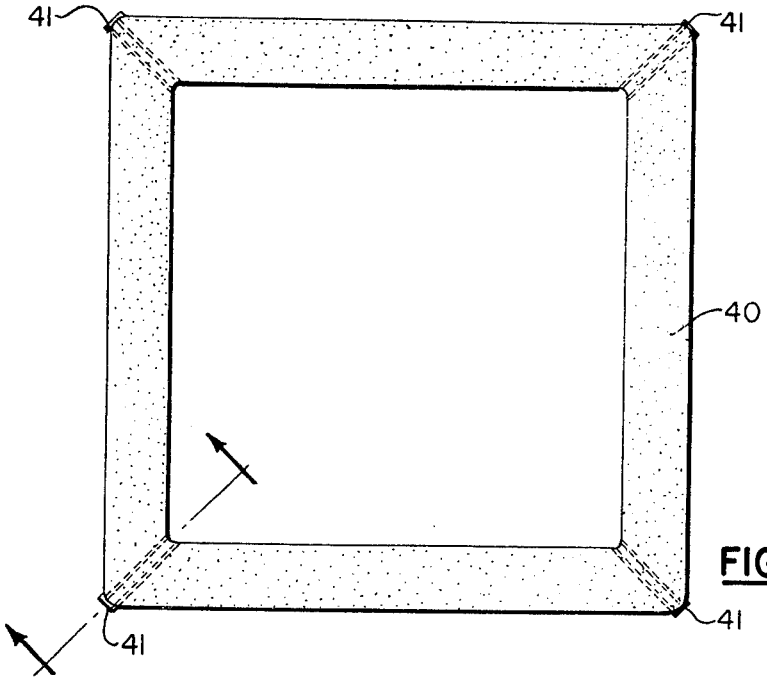
FIG. 6 in the drawing depicts a plan view of the floatation collar shown encircling the playpen embodiment of FIG. 3.

FIG. 3 of the drawings illustrates another preferred embodiment of the present invention whereby the playpen 10 can be readily relocated and/or floated at random in a pool without the necessity of it having to be supported upon the floor of the pool. This is accomplished by a provision of the floatation collar 40 which can comprise any suitable buoyant means, such as a hollow container, expanded cellular polystyrene, or the like. As shown in FIG. 6 of the drawings, the floatation collar 40 is of a shape sufficient to fit around and preferably encircle the present playpen 10.

Figure 7:
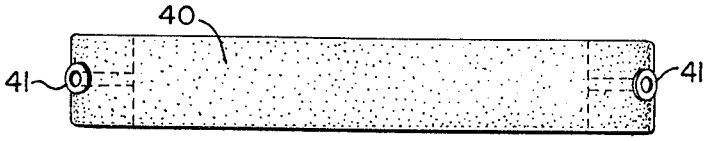
FIG. 7 represents a side elevation view of the collar shown in plan of FIG. 6.
Figure 8:
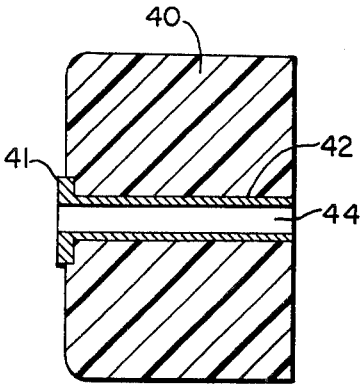
FIG. 8 in the drawing depicts a cross-sectional elevation view taken diagonally across one corner of the floatation collar along the line 8—8 of FIG. 6 of the drawings.

As shown in FIGS. 3, 6 and 7, in regard to the preferred floatation collar design depicted therein, the collar 40 is provided with the sleeve members or bushings 41 which telescopes through the collar 40 along a diagonal center line (see FIG. 6), being mounted essentially an equal distance along its height as shown in FIG. 7. The structural relationship is more clearly illustrated in FIG. 8 (which is a sectional elevation view taken from the line 8—8 of FIG. 6) which shows the sleeve support member 41 extending through the expanding cellular polystyrene floatation collar 40 by virtue of the hole 42 being provided therethrough.

The preferred collar design shown in FIG. 3, 6 and 7 of the drawings can be attached in any convenient manner to the playpen 10 such as, for example, by virtue of the toggle support pins 43 (FIG. 3). The support pins 43 are identical in structure to that of the pin 22 and 36, except however, being of sufficient length to completely bayonnet through the aperture 44 of the collar bushing 41 and through the respective corner stanchion by virtue of the holes 45 provided therein, the pins 43 being designed to accomplish the same safety aspects of the pins 22 and 36. The support stanchions 12, 13, 14 and 15 are preferably provided with a multitude of the holes 45 whereby the elevation of the collar 40 can be selected to achieve the operating conditions designed by the user. For example, the playpen can be made to sit at its maximum height out of the water by locating the platform 21 at its lowermost position and the depth of water within the playpen selected and fixed by virtue of adjusting the elevation of the floatation collar 40. Conversely, the playpen can be allowed to float at its lowest level by locating the floatation collar at its maximum height via adjustment with the pins 43, and the depth of water within the playpen can be determined by adjusting the elevation of the platform 21. This adjustable relationship between the platform 21 level and floatation collar 40 provides, among other things, a means for controlling the depth of the corner stanchions so as to prevent their contact with the floor 11 of the pool.

Figure 9:
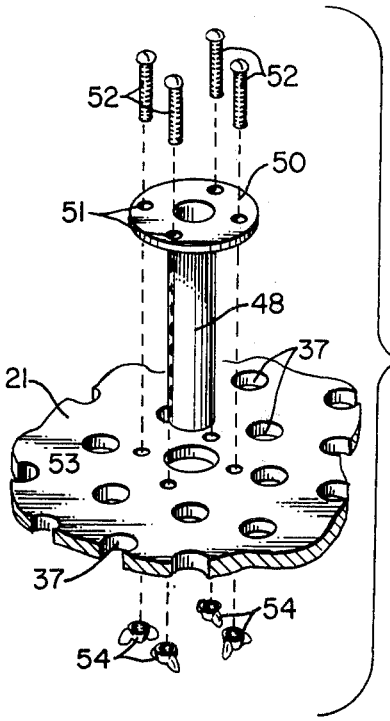
FIG. 9 in the drawing illustrates an isometric view of support means for supporting an umbrella upon the playpen bottom which is shown in a partial cut-away portion.

The present swimming pool playpen means 10 can be conveniently provided with the umbrella support stanchion 46, as illustrated in FIG. 3 of the drawings in combination with the umbrella phantom-lined 47 and in more detail in FIG. 9 of the drawings. Referring to the latter figure, the umbrella stand 46 further comprises the sleeve portion 48 which is adapted to receive the support shaft 49 of the umbrella 47 which bayonets therein. The support sleeve 48 in turn is rigidly affixed to the flange 50 which is supported upon and bolted to the support platform 21 by virtue of the bolt holes 51 provided in the flange 50, the bolts 52 then projecting therethrough and through the holes 53 provided in the platform 21, rigidly bolting the umbrella stand 46 of the platform 21 by virtue of the wingnuts 54.

It will be apparent to one skilled in the art that various modifications and/or changes in the basic design of the present invention can be made without departing from its true scope and spirit. For example, the present playpen means need not be made of a square design, but rather can be circular, or for that matter, of any shape. Moreover, the tubular superstructure described supra need not be employed, but rather, an integral structure may be employed, that is, various members, including the foraminous sides of the present playpen can be cast in one single structure. Moreover, the expanded cellular polystyrene floatation collar need not be formed in a continuous member, but rather, can be formed in separate components and operably affixed to the playpen at any convenient point of attachment, for example, beneath the platform 21.

It will also be appreciated by one skilled in the art that the materials of the construction of the present playpen as described in detail above can also be varied without departing from the basic objectives of the present invention. For example, the floatation collar need not be fabricated from expanded cellular polystyrene, but rather, could be a hollow tank or similar structure. Moreover, the structural components of the present invention can be made not only of rust resistant steel, but various plastic materials, such as polyvinyl chloride, or the like can be employed. The mesh or enclosure screen when not made integral with the present playpen, can be any suitable material other than nylon, for example a polyester, or the like. Accordingly, not wishing to be bound by the specific details of the above described structure and materials for construction, but rather, what is considered as the full scope and spirit of the present invention as set forth in the appended claims.

I claim:

1. The method of providing a safe play environment for a small child or infant in water of significant depth comprising the following steps:

a. providing a water compatible, relatively lightweight, portable playpen enclosure structure defining an enclosure of substantial size sufficient to allow a small child or infant to freely move around therein, said playpen enclosure structure being provided with members having openings therein which allow water to flow into the enclosure, said playpen enclosure structure including
   i. a basic playpen support frame;
   ii. rigid playpen platform means supported on said basic support frame for supporting the small child or infant within said enclosure during play in the water;
   iii. playpen wall enclosure means carried by said basic support frame around said platform means for restricting the small child or infant to said platform means;
   iv. playpen leg support means connected to said basic frame for supporting said basic frame on the water bottom; and
   v. variable support means connected within said platform, said basic frame and said leg means for allowing variation of the vertical position of said platform means with respect to the bottom of said leg means by a substantial amount, b. manually placing said relatively lightweight, portable playpen enclosure structure in the water so that the bottom of said playpen leg support means rests on the water bottom and water flows into the enclosure; and c. adjusting the vertical level of said playpen platform means by means of said variable support means so that said platform means will be located at least near the surface of the water; whereby a small child or infant placed in the enclosure defined by said playpen enclosure structure can safely play and move around in the water.

2. The method of claim 1 wherein:

in step (a) said basic support frame is provided with a series of vertically oriented stanchions each of which is provided with a series of support holes placed along a substantial length thereof and said variable support means is provided with a set of pins for inserting into said support holes; and in step (c) the step of adjusting the vertical level of said playpen platform means is accomplished by the following steps
   i. moving said playpen platform means and said vertically oriented stanchions vertically with respect to one another to provide the proper support height;
   ii. selecting the support holes at the appropriate level along said stanchions; and
   iii. inserting said pins into the selected support holes.

3. The method of claim 2 wherein:

in step (a) said vertically oriented stanchions are each provided with telescopic sections in which said series of support holes are located; and in step (c-i) the moving is accomplished by the telescopic action of said vertically oriented stachions.

4. The method of claim 2 wherein:

in step (a) said playpen platform means is provided with said set of pins; and in step (c-i) the moving is accomplished by moving said playpen platform means with respect to said vertically oriented stanchions while the latter is supported on the water bottom through said playpen leg support means.

* * * * *